United States Patent [19]

Mizelle

[11] Patent Number: 4,754,505

[45] Date of Patent: Jul. 5, 1988

[54] FOLDABLE MATTRESS SUPPORT WITH SUPPLEMENTAL BACK SPRING

[76] Inventor: Ned W. Mizelle, P.O. Box 5985, High Point, N.C. 27262

[21] Appl. No.: 41,377

[22] Filed: Apr. 23, 1987

[51] Int. Cl.[4] ..... A47C 17/04; A47C 19/00

[52] U.S. Cl. ..... 5/13; 5/226

[58] Field of Search ..... 5/12 R, 13, 37 R, 37 B, 5/37 C, 38–42, 47, 48, 226, 229, 187

[56] References Cited

U.S. PATENT DOCUMENTS

| | | | |
|---|---|---|---|
| 2,545,513 | 3/1951 | Emberson | 5/226 X |
| 2,727,250 | 12/1955 | Fox | 5/13 |
| 2,742,653 | 4/1956 | Woller | 5/13 X |
| 2,847,684 | 8/1958 | Pompon | 5/47 X |
| 4,494,258 | 1/1985 | Blevins et al. | 5/13 X |

*Primary Examiner*—Alexander Grosz
*Assistant Examiner*—Michael F. Trettel
*Attorney, Agent, or Firm*—Beveridge, DeGrandi & Weilacher

[57] ABSTRACT

A mattress is supported on a flexible deck which is surrounded by and connected to a foldable frame. A back section of the frame is movable between a horizontal sleeping position and a vertical seating position.

A supplemental back spring is attached to the frame and has a flex wire section and a collapsible section. The flex wire section provides horizontal support to the mattress in the seating position, and the collapsible section of the spring resists hammocking or sagging of the deck when the mattress is in the sleeping position.

10 Claims, 3 Drawing Sheets

FOLDABLE MATTRESS SUPPORT WITH SUPPLEMENTAL BACK SPRING

BACKGROUND OF THE INVENTION

This invention relates to foldable mattress supports such as those used in sofa sleeper mechanisms wherein a mattress is supported on a flexible deck which is surrounded by and connected to a foldable frame.

When such a mechanism is operated to fold the frame to its seating position, there is an inherent relaxation in the longitudinal tension applied to the deck by the frame, especially near the longitudinal centerline of the deck. In units where the mattress has a generally upright portion which supports the sofa cushions in a seating configuration, this loss in deck tension reduces the amount of support the mattress is able to give to the sofa cushions. Further, when such units are in their horizontal sleeping positions, there is a natural tendency toward sagging or hammocking, particularly near the center of the bed.

This invention addresses the problem of reduced back support for sofa cushions and the problem of hammocking by providing the frame with a novel spring arrangement.

SUMMARY OF THE INVENTION

This invention represents an improvement in conventional mattress supporting apparatus of the type wherein a mattress is supported on a flexible deck surrounded by and connected to a foldable frame. In such units, the frame has a head rail, a foot rail, and two longitudinal side rails, the latter being formed of pivotally interconnected sections. One of these pivotally interconnected sections is a back section which is movable between a generally horizontal sleeping position and a generally upright seating position.

The improvement of the present invention is a back spring means for providing supplemental support to the deck and a mattress lying thereon. The back spring means includes a resiliently collapsible section which is spaced from and supported by the back sections of the side rails. The collapsible section has a height which is vertically collapsible when the back section is in its sleeping position. Also, the back spring means has a longitudinal flex wire section which extends from the collapsible section toward the head rail to provide supplemental horizontal support to the mattress when the back section is in its generally upright seating position.

Preferably, the collapsible section of the back spring means has one end connected to a transverse cross member which lies below the deck and has its opposite ends connected to and supported by the back rail sections. The flex wire section is connected to the head rail by hooks which maintain tension in the flex wire section. The flex wire section is bowed convexly toward the deck, and it is connected to the hooks at a location which lies below the deck when the head rails are in their generally horizontal sleeping position.

The frame is preferably foldable to a position where a mattress thereon is folded into two generally horizontal mattress sections and one generally upright mattress section. The frame is connected to an upholstered furniture frame, and sofa seat cushions rest on one of the generally horizonal mattress sections while a sofa back cushion leans against the generally upright mattress section.

The resiliently collapsible section of the spring may be a formed wire spring which includes a transverse torsion bar with connector bars extending from its opposite ends.

DETAILED DESCRIPTION

Figure 1:
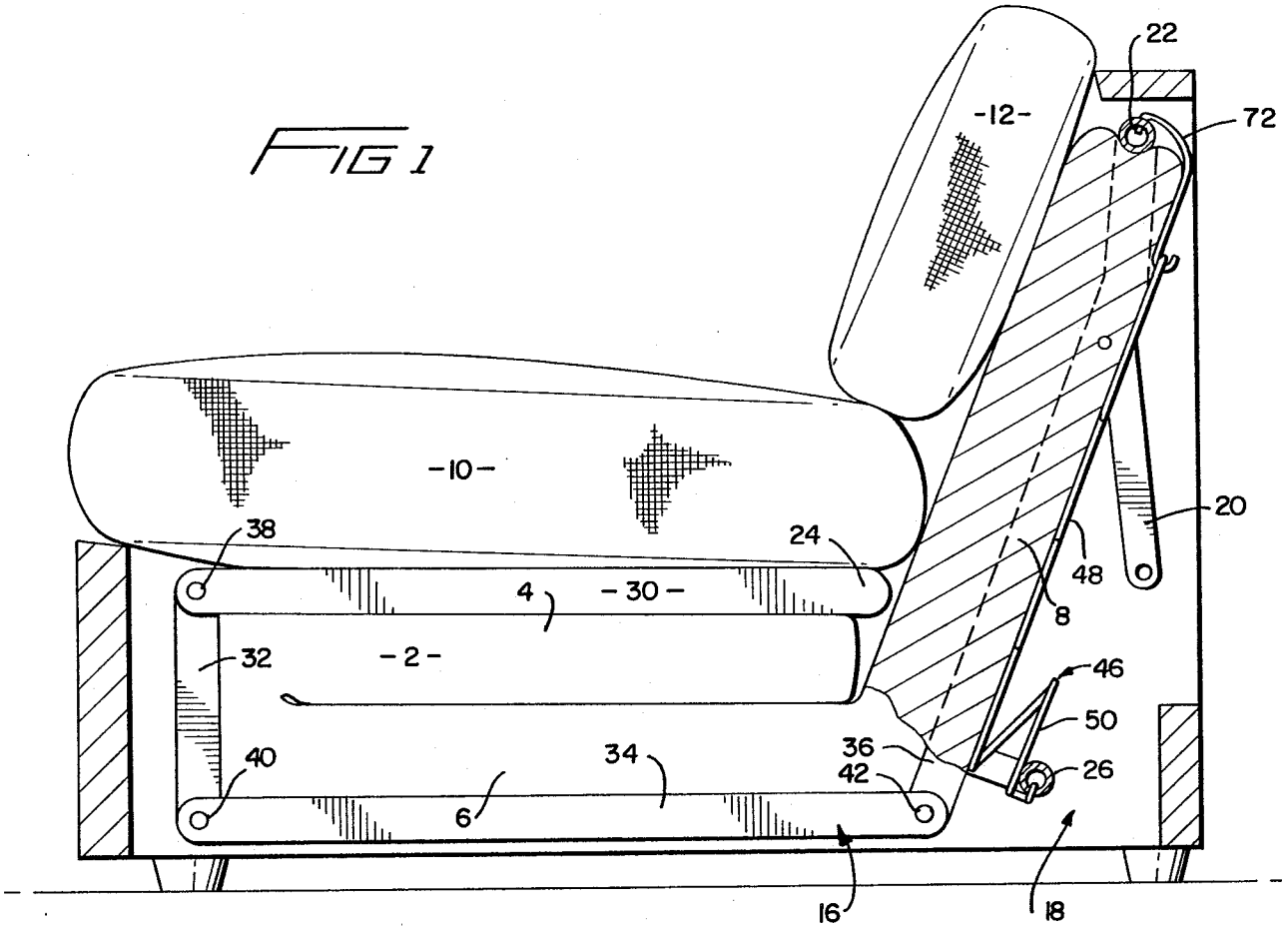
FIG. 1 is a side view, partially in section, of a sofa sleeper constructed according to the invention.

FIG. 1 shows a sofa sleeper which is generally conventional in the respect that, in its seating configuration, it's mattress 2 is folded into two generally horizontal mattress sections 4 and 6, and one generally upright mattress section 8. A sofa seat cushion 10 is supported on one of the horizontal sections 4 of the mattress, and a sofa back cushion 12 leans against the generally upright section 8 of the folded mattress.

The mattress 2 is supported on a flexible deck 14 which is surrounded by and connected to a foldable frame 16. The frame is connected to the upholstered furniture frame 18 of the sofa by two or more links, one of which is shown at 20. Suitable linkages for supporting the frame components and controlling their relative movement are disclosed in detail in U.S. Pat. No. 4,592,102, issued June 3, 1986, which is incorporated herein by reference.

Figure 3:
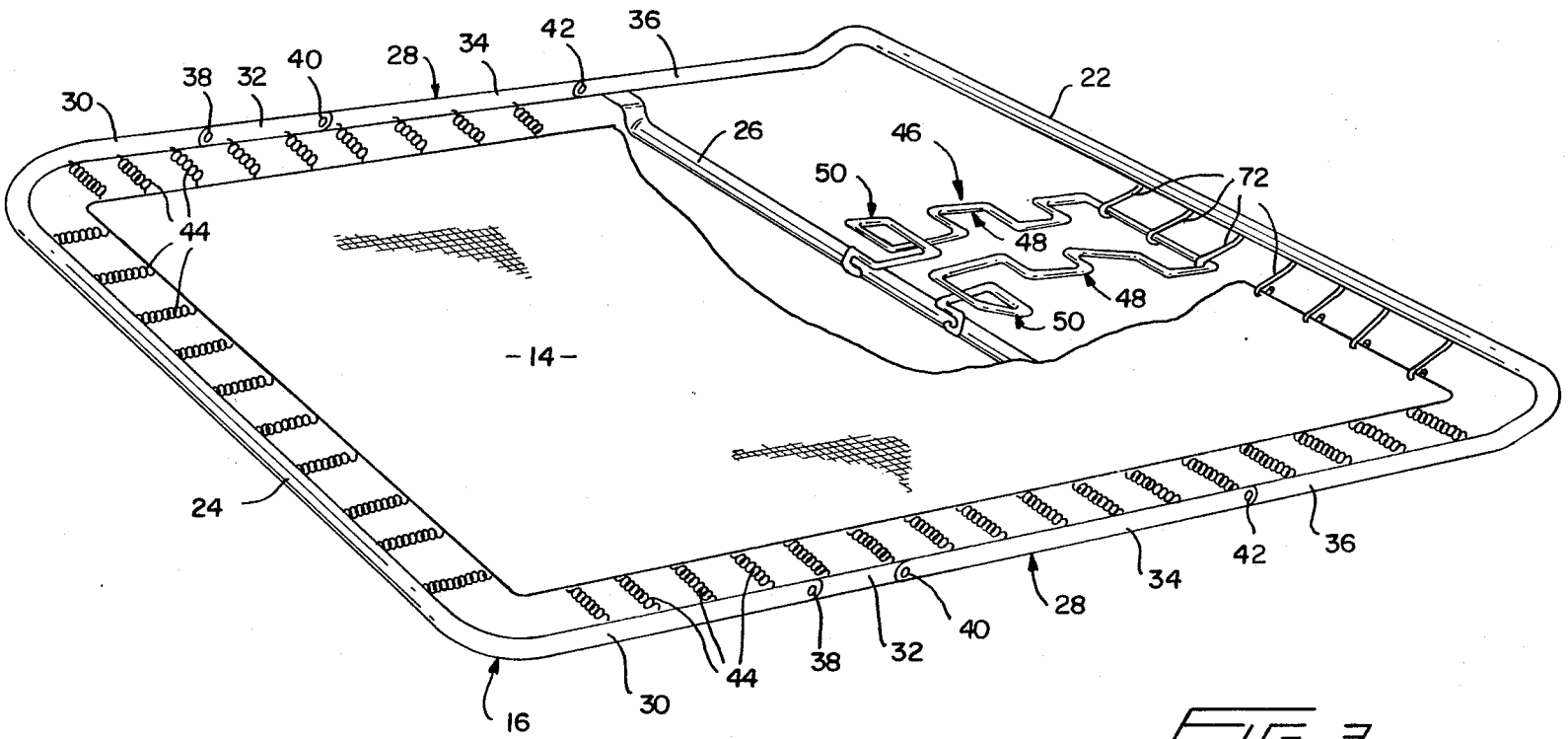
FIG. 3 is a perspective view which shows the mattress supporting frame unfolded in its generally horizontal sleeping position.

The frame 16 in its unfolded position is shown in FIG. 3 where it will be seen that it has a tubular head rail 22, a tubular foot rail 24, and a tubular intermediate cross rail 26 which is recessed in the respect that it is positioned below the horizontal plane of the frame. The side rails 28 of the frame are formed of a plurality of interconnected angle sections 30, 32, 34 and 36 which are pivotally interconnected at 40 and 42 to permit the frame and a mattress thereon to move between the folded seating position shown in FIG. 1 and the unfolded sleeping position shown in FIG. 3. The mattress is supported on the flexible deck 14 which, in turn, has its perimeter connected to the frame, preferably by longitudinally and transversely oriented helical springs 44 which maintain the deck 14 under tension. The recessed cross rail 26 has its opposite ends connected to and supported by the back rail sections 36 of the side rails 28.

It will be appreciated that when the frame 16 is folded from the position shown in FIG. 3 to the position shown in FIG. 1, there will be an inherent relaxation in the longitudinal tension in the deck 14, particularly in the vicinity of the longitudinal centerline of the bed. This slackening effect reduces to some extent the ability of the deck to provide back support near the center of the sofa when it is in its seating position, thereby providing inadequate support for the back cushion 12 shown in FIG. 1.

Figure 2:
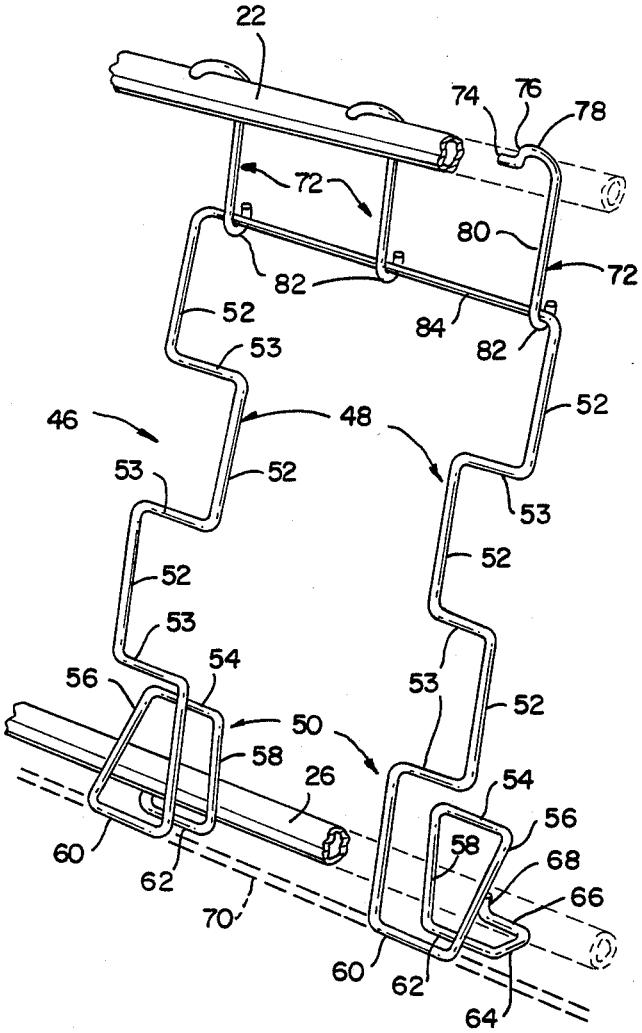
FIG. 2 is a perspective view of a supplemental back support spring constructed according to the invention, showing its connections to the tubular head rail and tubular recessed cross rail of the mattress supporting frame.

In order to provide adequate back support when the unit is folded, this invention calls for the utilization of a supplemental back spring 46 which is spaced inwardly from the side rails 28 of the foldable mattress-supporting frame. The preferred construction of this spring is best shown in FIG. 2 where it will be seen that it is formed of a single length of wire which has two flex wire sections 48 which are transversely spaced apart and two resiliently collapsible sections 50 which are also transversely spaced apart. Each collapsible section 50 is arranged so that its height is vertically collapsible when the back section 36 of the side rail is in its sleeping position. Each longitudinal flex wire section 48 extends from a respective collapsible section 50 toward the head rail 22 in order to provide horizontal support to the mattress 2 when the back section 36 is in the generally upright seating position shown in FIG. 1.

Each flex wire section 48 of the spring has a series of longitudinal sections 52 and transverse sections 53. The flex wire sections are bowed convexly toward the deck as can be seen in FIG. 1 and, due to the dimensions of the components, the flex wire sections 48 are maintained under tension in order to enhance their supportive effect.

The collapsible sections 50 of the back spring are preferably formed of a plurality of straight wire sections which form what is sometimes referred to as a "fishmouth." Each collapsible section has a transverse torsion bar 54 with connector bars 56 and 58 extending from its opposite ends.

At the opposite ends of the connector bars 56 and 58, there are transverse bars 60 and 62 which are also subjected to torsion during normal operation of the collapsible spring section. To affix the collapsible section of the spring to the recessed cross tube 26, the end of the spring has a leg 64 which is transverse to the tube, a leg 66 which extends longitudinally of the tube, and an end portion 68 which extends radially through a hole in the tube to hold the spring in a correct position. Preferably, a transverse wire 70 is clipped to the bars 60 in order to maintain the collapsible portions of the springs at a fixed spacing relative to each other.

The upper end of the spring 46 is connected to the head rail 22 by a plurality of hooks 72, the details of which are best shown in FIG. 2. The geometry of these hooks will be described with respect to the tubular head rail. Each hook 72 has an axial retaining portion 74 which lies inside the head rail tube, a radial portion 76 which extends through a hole bored in the tube, a tangential portion 78 which protrudes rearwardly from the tube as shown in FIG. 1, and a generally vertical portion 80 which extends downwardly to a loop 82 which engages the transverse wire 84 of the spring 46. The loop connects the hook to the spring at a location which lies below the deck when the head rails are horizontal.

The technical advantages realized from the invention will be evident to persons familiar with the art. As can be seen in FIG. 1, the flex wire section of the spring assists in supporting the generally upright portion of the mattress, thus also enhancing the support for the back cushion which leans against the mattress. When the frame is unfolded and moved to its generally horizontal sleeping position shown in FIG. 3, the vertically collapsible portions of the spring will be located in an area which sometimes hammocks or sags. In this respect, the back spring serves important functions both when the unit is in the unfolded bed position and when it is in the folded seating position.

The spring preferably has two collapsible and flex wire portions and it is formed of a single piece of wire. However it is possible to fabricate the spring with only one flex wire portion and one collapsible portion, and/or to form the spring of two or more lengths of wire which are connected together by clips or other conventional attachment means.

Persons familiar with the field of the invention will recognize that it is capable of numerous variations and modifications. Therefore, it is emphasized that the invention is not limited only to the embodiment disclosed herein, but is embracing of modifications thereto and variations thereof which fall within the spirit of the following claims.

I claim:

1. Apparatus for supporting a foldable mattress in an article of furniture such as a sofa sleeper, said apparatus including a flexible deck which is surrounded by and connected to a foldable frame, said frame having a head rail, a foot rail and two longitudinal side rails, said side rails being formed of pivotally interconnected sections, one of said sections of each side rail being a back section which is movable between a generally horizontal sleeping position and a generally upright seating position, back spring means for providing supplemental support to the deck and a mattress lying thereon, said back spring means including a resiliently collapsible section which is spaced from and supported by said back sections of the side rails, said collapsible section having a height which is vertically collapsible when the back section is in its sleeping position, said back spring means also having a longitudinal flex wire section which extends from the collapsible section toward the head rail to provide supplemental horizontal support to the mattress when the back section is in its generally upright seating position.

2. Apparatus according to claim 1 wherein the frame has a cross member which extends transversely below the deck when the back section is in its generally horizontal sleeping position, said cross member having opposite ends which are connected to and supported by the back rail sections, said collapsible section of the back spring means having one end connected to the cross member and one end connected to the flex wire section.

3. Apparatus according to claim 1 also including an upholstered furniture frame, and means for connecting the foldable frame to the furniture frame.

4. Apparatus according to claim 1 having a mattress supported on the deck, said sections of the side rails being movable to positions where said mattress is folded into two generally horizontal mattress sections and one generally upright mattress section.

5. Apparatus according to claim 4 having a sofa cushion resting on one of the generally horizontal mattress sections, and a sofa cushion leaning against said generally upright mattress section.

6. Apparatus according to claim 1 wherein said resiliently collapsible section of the spring means is a formed wire spring which includes a transverse torsion bar which has connector bars extending from its opposite ends.

7. Apparatus according to claim 1 having hook means which connect the head rail to the flex wire section of the spring means, said hook means being operable to maintain tension in the flex wire section of the spring means.

8. Apparatus according to claim 7 wherein the hook means connects to the flex wire section of the spring means at a location which lies below the deck when the head rails are in their generally horizontal sleeping position.

9. Apparatus according to claim 1 wherein the longitudinal flex wire section of the spring means is bowed convexly toward the deck.

10. Apparatus according to claim 1 wherein the spring means is formed of a single length of wire which has two flex wire sections which are transversely spaced apart and two resiliently collapsible sections which are transversely spaced apart.

* * * * *